US007146836B2

(12) United States Patent
Hayashi

(10) Patent No.: US 7,146,836 B2
(45) Date of Patent: Dec. 12, 2006

(54) PIERCING METHOD FOR MANUFACTURING OF SEAMLESS PIPE

(75) Inventor: Chihiro Hayashi, Sendai (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/331,100

(22) Filed: Jan. 13, 2006

(65) Prior Publication Data

US 2006/0174670 A1 Aug. 10, 2006

Related U.S. Application Data

(63) Continuation of application No. 10/559,264, filed as application No. PCT/JP04/07698 on Jun. 3, 2004.

(30) Foreign Application Priority Data

Jun. 6, 2003 (JP) ..... 2003-162416

(51) Int. Cl.
*B21B 19/04* (2006.01)

(52) U.S. Cl. ..... 72/97; 72/366.2

(58) Field of Classification Search ..... 72/96, 72/97, 100, 365.2, 366.2, 209, 235
See application file for complete search history.

(56) References Cited

U.S. PATENT DOCUMENTS 4,470,282 A * 9/1984 Hayashi ..... 72/97
4,827,750 A 5/1989 Hayashi
5,636,542 A * 6/1997 Yamakawa et al. ..... 72/97
5,699,690 A * 12/1997 Furugen et al. ..... 72/69
5,713,234 A 2/1998 Yamakawa et al.

FOREIGN PATENT DOCUMENTS

| | | |
|---|---|---|
| JP | 5-23842 | 4/1993 |
| JP | 8-4811 | 1/1996 |
| WO | WO96/21526 | 7/1996 |

* cited by examiner

*Primary Examiner*—Ed Tolan
(74) *Attorney, Agent, or Firm*—Clark & Brody

(57) ABSTRACT

A piercing method for manufacturing a seamless pipe capable of suppressing the rotary forging effects and suppressing the redundant shear strain without excessive narrowing of the roll diameter is provided. This method is characterized by holding a feed angle β and a cross angle γ of main rolls in a range satisfying the following expressions (1) to (3), setting the relationship between outer diameter "$d_0$" of the solid billet and the outer diameter "d" and thickness "t" of a hollow piece after piercing so as to satisfy the following expression (4), and further setting the relationship between inlet diameter $D_1$ and outlet diameter $D_2$ of the main roll with the above-mentioned "$d_0$", "d" and γ so as to satisfy the following expression (5)

$$8° \leqq \beta \leqq 20° \quad (1)$$

$$5° \leqq \gamma \leqq 35° \quad (2)$$

$$15° \leqq \beta+\gamma \leqq 50° \quad (3)$$

$$1.5 \leqq -\psi_r/\psi_\theta \leqq 4.5 \quad (4)$$

$$(d/d_0)/(0.75+0.025\gamma) \leqq D_2/D_1 \quad (5)$$

In the expression (4), $\psi_r=\ln(2t/d_0)$ and $\psi_\theta=\ln\{2(d-t)/d_0\}$.

4 Claims, 6 Drawing Sheets

(a)

(b)

PIERCING METHOD FOR MANUFACTURING OF SEAMLESS PIPE

CROSS REFERENCES TO RELATED APPLICATIONS

This is a continuation of U.S. Application No. 10/559,264 filed Dec. 2, 2005, which is a National Phase Entry of PCT/JP2004/007698 filed Jun. 3, 2004.

TECHNICAL FIELD

The present invention relates to a method for piercing a billet in the manufacturing process of a seamless pipe. More specifically, it relates to a piercing method, capable of manufacturing a thin-walled hollow piece from a billet, at a high working ratio.

TECHNICAL BACKGROUND

The most commonly adapted methods for manufacturing seamless pipes are the Mannesmann-plug mill method and Mannesmann-mandrel mill method. These methods comprise processes of piercing a solid billet, which is heated to a predetermined temperature in a furnace, by a piercer in order to form a bar-like hollow piece, working the hollow piece into a hollow piece by reducing mainly the wall thickness thereof by an elongator such as a plug mill or a mandrel mill, and then working the hollow piece into a seamless pipe of a predetermined size by reducing mainly the outer diameter thereof by a reducing mill such as a sizer or stretch reducer. The present invention relates to the first process, that is the piercing process among the above processes.

First of all, inventions that have been proposed by the present inventor in the following patent documents 1 and 2 will be described as related arts.

Patent Document 1:

Publication of Examined Patent Application Hei 5-23842

Patent Document 2:

Publication of Examined Patent Application Hei 8-4811

The invention of the patent document 1 (hereinafter referred to as the first prior invention) relates to a method for manufacturing a seamless pipe, characterized by keeping the relationship between a feed angle β of both-ends-supported cone-type main rolls installed so they are opposed laterally or vertically across a pass line for passing a billet and a hollow piece, and a cross angle γ of the main rolls within the range of the following expressions (1) to (3); by setting the relationship of the diameter "$d_0$" of a solid billet with the outer diameter "d" and thickness "t" of the hollow piece after piercing, so as to satisfy the following expression (4); and by setting the piercing ratio to 4.0 or more, and the pipe expansion ratio to 1.15 or more or the "wall thickness/outer diameter" ratio to 6.5 or less.

The feed angle β is an angle of the axial line of the rolls to a horizontal plane or a vertical plane of the pass line. The cross angle γ is an angle of the axial line of the rolls to a vertical plane or a horizontal plane of the pass line.

$$8° \leqq \beta \leqq 20° \quad (1)$$

$$5° \gamma \leqq 35° \quad (2)$$

$$15° \leqq \beta + \gamma \leqq 50° \quad (3)$$

$$1.5 \leqq -\psi_r/\psi_\theta \leqq 4.5 \quad (4)$$

wherein $\psi_r = 1n(2t/d_0)$ and $\psi_\theta = 1n\{2(d-t)/d_0\}$

The method of the first prior invention is adapted to suppress rotary forging effects and an redundant shear strain, which dominantly occur in the piercing process, particularly in the thin-walled piercing process with a high working ratio, as much as possible by holding the feed angle β and the cross angle γ of the rolls in the proper ranges, whereby the inner surface flaw or lamination at the thickness center, which occurs in a pipe made of stainless steel or high-alloy steel, is prevented. This method is also adapted to reduce operational trouble such as flaring or peeling of a pipe wall or tail clogging, by making the distribution of circumferential strain $\psi_\theta$ and radial strain $\psi_r$ appropriately in order to satisfy the relationship of the above-mentioned expression (4).

The first prior invention made it possible to produce a pipe of a difficult-to-work material, which used to be produced by the Ugine-Sejournet extrusion process, by the Mannesmann pipe making process. In addition to that, the first prior invention provided a process for thin-walled piercing with a high working ratio, and also skipping or shortening the succeeding elongating process and reducing process. Accordingly, this invention significantly contributed to streamlining the manufacturing process of the seamless pipes.

For example, a Mannesmann piercer and a rotary elongator, used in the Mannesmann-plug mill system, were replaced by one cross piercing mill, which made it possible to reduce the so-called "double piercing method" to a "single piecing method". The Mannesmann-plug mill system is the system that includes the processing by the Mannesmann piercer, a rotary enlogator, a plug mill, a reeler and a sizer.

In the Mannesmann-mandrel mill system, the number of roll-stands of the mandrel mill can be reduced by replacing the Mannesmann piercer by the cross piercing mill. The Mannesmann-mandrel mill system is a system includes the processing by the Mannesmann piercer, a mandrel mill and a stretch reducer.

Further, in reference to the Mannesmann-Assel mill system, which includes processing by the Mannesmann piercer, the Assel mill and the stretch reducer, the cross piercing mill was also introduced one after another. The use of the cross piercing mill has definite operational advantages such as integration of the billet size and the shortening of preparation time, since the so-called "size-free rolling" for manufacturing many sizes of hollow pieces from a single size billet can be carried out only by replacing the plug.

The invention of Patent Document 2 (hereinafter referred to as the second prior invention) was attained with the intention of optimizing the relationship between the diameter of a cone-type main roll and the diameter of a solid billet. In this invention, in order to suppress the rotary forging effects and the redundant shear strain as much as possible, the diameter of the gorge part of the cone-type main roll, i.e. the roll gorge diameter, $D_g$ and the billet diameter $d_0$ are set so as to satisfy the following expression (a).

$$2.5 \leqq D_g/d_0 \leqq 4.5 \quad (a)$$

In the second prior invention, it is explained that in order to stabilize the piercing of the difficult-to-work material, such as stainless steel or high-alloy steel, without inner surface flaws or lamination, it is necessary to minimize the roll gorge diameter as much as possible relative to the billet diameter. However, in order to minimize the roll gorge diameter, the inlet-side and the outlet-side roll shaft diameters should be minimized due to the roll structure. This causes lack of strength in the bearings which support the roll shaft. In case of the cone-type roll, particularly, the fatigue strength of the inlet-side bearing becomes insufficient, causing a problem of durability. Accordingly, excessive minimization of the roll gorge diameter cannot be recommended in practical operation.

DISCLOSURE OF THE INVENTION

[Subject to be Solved by the Invention]

It is an objective of the present invention to provide a piercing method capable of suppressing the rotary forging effects as much as possible and also suppressing the redundant shear strain as much as possible without excessively minimizing the roll gorge diameter.

[Means for Solving the Problems]

As a result of the earnest studies to attain the above objective, the present inventor has developed this invention relating to the following piercing method. The explanations of reference numerals in the following description are shown in FIG. 1.

A piercing method for manufacturing a seamless pipe that comprises;

holding a feed angle β and a cross angle γ of both-ends-supported cone-type main rolls installed to be opposed laterally or vertically across a pass line in a range satisfying the following expressions (1) to (3), setting the relationship of the outer diameter "$d_0$" of a solid billet with the outer diameter "d", and wall thickness "t" of a hollow piece after piercing, so as to satisfy the following expression (4), and setting the relationship of inlet diameter $D_1$ and outlet diameter $D_2$ of the main rolls with the above-mentioned "$d_0$", "d" and γ so as to satisfy the following expression (5).

$$8° \leqq \beta \leqq 20° \quad (1)$$

$$5° \leqq \gamma \leqq 35° \quad (2)$$

$$15° \leqq \beta+\gamma \leqq 50 \quad (3)$$

$$1.5 \leqq -\psi_r/\psi_\theta \leqq 4.5 \quad (4)$$

$$(d/d_0)/(0.75+0.025\gamma) \leqq D_2/D_1 \quad (5)$$

In the expression (4), $\psi_r=\ln(2t/d_0)$, and $\psi_\theta=\ln\{2(d-t)/d_0\}$ The feed angle β is an angle of the axial line of the roll to a horizontal plane or vertical plane of the pass line. The cross angle γ is an angle of the axial line of the roll to a vertical plane or horizontal plane of the pass line.

In the method of the present invention, the relationship of the inlet diameter $D_1$ and the outlet diameter $D_2$ of the main rolls with the above $d_0$, d and γ desirably satisfies the following expression (6).

$$D_2/D_1 \leqq (d/d_0)/(1.00-0.027\gamma) \quad (6)$$

The effect of the method of the present invention can be sufficiently obtained in a piercing with a piercing ratio of 4.0 or more, a pipe expansion ratio of 1.15 or more or a "wall thickness/outer diameter ratio" of a hollow piece of 6.5 or less, where the rotary forging effects and the redundant deformation become noticeable.

BEST MODE FOR CARRYING OUT THE INVENTION

The ranges of values of the feed angle β and the cross angle γ in the method of the present invention are the same as those in the above-mentioned inventions of Patent Documents 1 and 2. These ranges were determined from the viewpoint of diminishing the rotary forging effects and suppressing the redundant shear strain as much as possible.

The range of the ratio of radial logarithmic strain $\psi_r$ to circumferential logarithmic strain $\psi_\theta$, i.e., "$-\psi_r/\psi_\theta$" is the same as in the invention of said Patent Document 1. This is based on the principle of how the rolling reduction in piercing is distributed in the longitudinal direction and the circumferential direction, and the deviation from the principle causes flaring Gapping phenomenon) or peeling of the pipe wall or tail clogging, which may stop the piercing operation itself.

A main characteristic of the present invention is based on a fact wherein the roll shape relative to the billet diameter has significant influence mainly on the rotary forging effects. This was found by the present inventor and will be described below.

In a corn-type roll, the relationships of the ratio of the inlet diameter $D_1$ to the outlet diameter $D_2$ between a pipe material and the main roll of a cone-type roll, i.e., a diameter expansion ratio "$D_2/D_1$"; the ratio of the hollow piece outer diameter "d" to the billet outer diameter "$d_0$", i.e., a pipe expansion ratio of the pipe material "$d/d_0$"; and the cross angle γ were investigated from the point of suppressing the rotary forging effects and the redundant shear strain.

Prior to the experiments, a selection of an index showing the roll shape was performed. A study of whether or not various possible indexes could be indexes, which show the relationship with the rotary forging effects or the redundant shear strain, was made. Consequently, the ratio of the pipe expansion ratio of the pipe material "$d/d_0$" to the diameter expansion ratio "$D_2/D_1$" of the cone-type roll, that is to say $(d/d_0)/(D_2/D_1)$, was taken as the index.

A barrel width ratio "$L_1/L_2$" may also be regarded as an index. $L_1$ is the inlet-side barrel width across the gorge position of the roll shown in FIG. 1, i.e., the distance from a roll biting start point of the pipe material to the roll gorge. $L_2$ is the outlet-side barrel width. However, this ratio has no direct relationship with the rotary forging effects or the redundant shear deformation, and the proper range thereof was determined from another viewpoint. It is a general practice to add an unnecessary margin to the barrel width, and therefore it is difficult to define the barrel width ratio per se.

In general, the roll diameter expansion ratio "$D_2/D_1$" becomes larger as the roll cross angle γ becomes larger, it results in a further sharpened cone shape. However, on condition that the roll cross angle is the same and the outlet-side barrel width $L_2$ is the same, the roll diameter expansion ratio "$D_2/D_1$" inevitably becomes smaller as the pipe expansion ratio "$d/d_0$" of the pipe material is larger. Thus, roll design must be performed so as to give a proper "$D_2/D_1$", considering "$d/d_0$", and the difficulty of the roll design depends on this point.

The roll design must be made from the point of diminishing the rotary forging effects in front of a plug in piercing and also minimizing the redundant shear deformation typified by the circumferential shear strain $\gamma_{r\theta}$ after piercing, since the embitterment of the pipe material by the rotary forging effects causes inner surface flaw on the pipe, and the redundant shear deformation is a factor of propagating the inner surface flaw.

The present inventor made experiments of piercing a carbon steel billet as a sample using an experimental cross piercing mill while variously changing the roll shape in order to examine the influence of the roll shape on the rotary forging effects and the redundant shear strain in detail. The experimental conditions are shown in Tables 1 and 2. The wall thickness t of the hollow piece after piercing was set so as to have a "wall thickness/outer diameter" ratio, i.e., (t/d)×100, of 2.5 to 3%.

TABLE 1

| γ | Dg (mm) | $D_1$ (mm) | $D_2$ (mm) | $D_2/D_1$ | $d_0$ (mm) | d (mm) | $d/d_0$ | $\frac{d/d_0}{D_2/D_1}$ | Evaluation |
|---|---|---|---|---|---|---|---|---|---|
| 0° | 400 | 380 | 380 | 1.00 | 70 | 70 | 1.00 | 1.00 | ● |
| | | | 370 | 0.97 | | 84 | 1.20 | 1.24 | ● |
| | | | 355 | 0.93 | | 105 | 1.50 | 1.62 | ● |
| | | | 325 | 0.86 | | 140 | 2.00 | 2.33 | ● |
| 5° | 400 | 360 | 430 | 1.19 | 70 | 70 | 1.00 | 0.84 | ○ |
| | | | 410 | 1.14 | | 84 | 1.20 | 1.05 | ● |
| | | | 390 | 1.08 | | 105 | 1.50 | 1.39 | ● |
| | | | 370 | 1.03 | | 140 | 2.00 | 1.92 | ● |
| 10° | 400 | 340 | 485 | 1.43 | 70 | 70 | 1.00 | 0.70 | ○ |
| | | | 450 | 1.32 | | 84 | 1.20 | 0.91 | ○ |
| | | | 415 | 1.22 | | 105 | 1.50 | 1.23 | ● |
| | | | 395 | 1.16 | | 140 | 2.00 | 1.72 | ● |
| 15° | 400 | 310 | 525 | 1.69 | 70 | 70 | 1.00 | 0.59 | ○ |
| | | | 500 | 1.61 | | 84 | 1.20 | 0.75 | ○ |
| | | | 475 | 1.53 | | 105 | 1.50 | 0.98 | ○ |
| | | | 450 | 1.45 | | 140 | 2.00 | 1.37 | ● |
| 20° | 400 | 280 | 560 | 2.00 | 70 | 70 | 1.00 | 0.50 | ○ |
| | | | 540 | 1.93 | | 84 | 1.20 | 0.62 | ○ |
| | | | 520 | 1.86 | | 105 | 1.50 | 0.81 | ○ |
| | | | 490 | 1.75 | | 140 | 2.00 | 1.14 | ○ |
| 25° | 400 | 240 | 600 | 2.50 | 70 | 70 | 1.00 | 0.40 | ○ |
| | | | 575 | 2.40 | | 84 | 1.20 | 0.50 | ○ |
| | | | 550 | 2.29 | | 105 | 1.50 | 0.65 | ○ |
| | | | 520 | 2.17 | | 140 | 2.00 | 0.92 | ○ |
| 30° | 400 | 200 | 650 | 3.25 | 70 | 70 | 1.00 | 0.31 | ○ |
| | | | 630 | 3.15 | | 84 | 1.20 | 0.38 | ○ |
| | | | 600 | 3.00 | | 105 | 1.50 | 0.50 | ○ |
| | | | 570 | 2.85 | | 140 | 2.00 | 0.70 | ○ |

TABLE 2

| γ | Dg (mm) | $D_1$ (mm) | $D_2$ (mm) | $D_2/D_1$ | $d_0$ (mm) | d (mm) | $d/d_0$ | $\frac{d/d_0}{D_2/D_1}$ | Evaluation |
|---|---|---|---|---|---|---|---|---|---|
| 0° | 500 | 480 | 480 | 1.00 | 70 | 70 | 1.00 | 1.00 | ● |
| | | | 470 | 0.98 | | 84 | 1.20 | 1.22 | ● |
| | | | 455 | 0.95 | | 105 | 1.50 | 1.59 | ● |
| | | | 425 | 0.89 | | 140 | 2.00 | 2.22 | ● |
| 5° | 500 | 460 | 530 | 1.15 | 70 | 70 | 1.00 | 0.87 | ● |
| | | | 510 | 1.11 | | 84 | 1.20 | 1.08 | ● |
| | | | 490 | 1.07 | | 105 | 1.50 | 1.41 | ● |
| | | | 470 | 1.02 | | 140 | 2.00 | 1.76 | ● |
| 10° | 500 | 440 | 585 | 1.33 | 70 | 70 | 1.00 | 0.75 | ○ |
| | | | 550 | 1.25 | | 84 | 1.20 | 0.96 | ● |
| | | | 525 | 1.19 | | 105 | 1.50 | 1.28 | ● |
| | | | 495 | 1.13 | | 140 | 2.00 | 1.76 | ● |
| 15° | 500 | 410 | 625 | 1.52 | 70 | 70 | 1.00 | 0.66 | ○ |
| | | | 600 | 1.46 | | 84 | 1.20 | 0.82 | ○ |
| | | | 575 | 1.40 | | 105 | 1.50 | 1.08 | ● |
| | | | 550 | 1.34 | | 140 | 2.00 | 1.49 | ● |
| 20° | 500 | 380 | 660 | 1.73 | 70 | 70 | 1.00 | 0.58 | ○ |
| | | | 640 | 1.68 | | 84 | 1.20 | 0.71 | ○ |
| | | | 620 | 1.63 | | 105 | 1.50 | 0.92 | ○ |
| | | | 590 | 1.55 | | 140 | 2.00 | 1.28 | ● |
| 25° | 500 | 340 | 700 | 2.06 | 70 | 70 | 1.00 | 0.49 | ○ |
| | | | 675 | 1.98 | | 84 | 1.20 | 0.61 | ○ |
| | | | 650 | 1.91 | | 105 | 1.50 | 0.78 | ○ |
| | | | 620 | 1.82 | | 140 | 2.00 | 1.10 | ○ |
| 30° | 500 | 300 | 750 | 2.50 | 70 | 70 | 1.00 | 0.40 | ○ |
| | | | 730 | 2.43 | | 84 | 1.20 | 0.49 | ○ |
| | | | 700 | 2.33 | | 105 | 1.50 | 0.65 | ○ |
| | | | 670 | 2.23 | | 140 | 2.00 | 0.89 | ○ |

An example of the influence of the diameter expansion ratio "$D_2/D_1$" and the pipe expansion ratio "$d/d_0$" on the rotary forging effects is shown in FIGS. 2(*a*) and (*b*). An example of the influence of the diameter expansion ratio "$D_2/D_1$" and the pipe expansion ratio "$d/d_0$" on the redundant shear strain is shown in FIGS. 3(*a*) and (*b*).

The influence of the roll shape on the rotary forging effects was evaluated by stopping the main rolls and the disk roll in the middle of piercing in order to form "intermediate-stop material", and then collecting a sheet-like small tensile test piece with parallel length of 25 mm and a thickness of 3 mm in the diameter direction (the direction of a guide), right-angled to the axial direction from the tip of the plug. Then perform a tensile test at room temperature in order to examine the influence of the roll shape on the reduction of area (%). The rotary forging effects appear more clearly in the reduction of area (%) than in elongation (%) of the tensile test.

A measurement of the circumferential shear strain $\gamma_{r\theta}$ for the redundant shear strain was carried out by a pin burying method. Namely, a plurality of pins were buried parallel to the axis along the diameter of a solid billet, and the circumferential shear strain $\gamma_{r\theta}$ of the hollow piece after piercing was measured across the hollow piece.

As is apparent from FIG. 2, for example, assuming that the roll cross angle γ is fixed, the reduction of area can be set larger as the pipe expansion ratio "$d/d_0$" is smaller, or the diameter expansion ratio "$D_2/D_1$" is larger. Namely, the rotary forging effects can be diminished. In other words, the range of the feed angle β, where the reduction of area of the pipe material in front of the plug is larger than that of the material steel, can be extended.

As it is also apparent from FIG. 3, the circumferential shear strain can be minimized as the pipe expansion ratio is smaller, or the diameter expansion ratio is larger. Namely, the redundant shear strain can be suppressed. Accordingly, even with an increased pipe expansion ratio, the circumferential shear strain never becomes too large if the roll shape, with a sufficiently large roll cross angle γ, is ensured to increase the diameter expansion ratio.

In case of an improper roll shape, or when the roll cross angle is small compared with the pipe expansion ratio, the roll outlet diameter $D_2$ gets close to the gorge diameter $D_g$, due to an extremely minimized diameter expansion ratio for ensuring the pipe expansion ratio. Therefore reduction in outlet-side circumferential speed of the rolls at a pipe material separation point weakens an effect of drawing the pipe material to the outlet side. This makes the slip phenomenon between the roll and the pipe material noticeable. The slip phenomenon is also affected by the billet diameter, in which the slip is also increased on the inlet side, and therefore the rotary forging effects begin to appear due to an increase in the rotary forging frequency, and the range of the feed angle β, which makes the pipe material in front of the plug more brittle than the material steel, is extended. The rotary forging frequency is the number of the revolutions of the billet from the time when it is bitten by the rolls to the time when it is carried to the plug tip.

Needless to say, the redundant shear strain begins to obviously appear. An extreme example of this is a case wherein the roll outlet diameter $D_2$ gets close to the inlet diameter $D_1$. The "redundant shear strain" is the generic name of circumferential shear strain $\gamma_{r\theta}$, the shear strain due to surface twist $\gamma_{\theta 1}$, and the longitudinal shear strain $\gamma_{1r}$.

The relationships between the pipe expansion ratio "$d/d_0$", the roll diameter expansion ratio "$D_2/D_1$", and the roll cross angle γ are shown in FIGS. 4 and 5. The result of whether the roll shape is correct or not is also shown in these drawings. Namely, a white circle shows a proper roll shape, and a black circle shows an improper shape.

It is necessary to determine the propriety of the roll shape based on the rotary forging effects. Therefore, whether or not the ductility (reduction of area) of the pipe material in front of the plug can be made larger than the reduction of area of the material steel, i.e., the billet, was taken as the criterion. Piercing was performed with a feed angle (β) of 12°, and as described above, a tensile test was carried out by use of a sheet-like small tensile test piece with a parallel length of 25 mm and a thickness of 3 mm collected from a cross section of the pipe material in front of the plug in order to examine whether or not the reduction of area of the pipe material in front of the plug is larger than the reduction of area of the material steel. White circle show cases with a larger reduction of area and other cases are shown by black circles. It is found from FIGS. 4 and 5 that the condition of a proper roll shape is as follows.

$$(5/6)+(1/3)(d/d_0)\leqq(D_2/D_1)$$

$$1+0.03\gamma\leqq(D_2/D_1)$$

As described above, the relationship between "$D_2/D_1$", "$d/d_0$" and γ can be clarified in the graphs by adapting "$D_2/D_1$" as the roll shape index, but it becomes more difficult to express the three variables collectively in mathematical terms. In order to avoid this problem, the present inventor selected, as the roll shape index, the ratio of the pipe expansion ratio "$d/d_0$" of the pipe material to the diameter expansion ratio "$D_2/D_1$" of the roll, that is to say "$(d/d_0)/(D_2/D_1)$".

FIG. 6 is a graph showing the relationship between the roll shape index "$(d/d_0)/(D_2/D_1)$", the pipe expansion ratio "$d/d_0$" and the cross angle γ. Although "$d/d_0$" remains as a parameter with "$(d/d_{y/(D2}/D_1)$" as the ordinate and γ as the abscissa respectively, the condition giving a proper roll shape can be expressed by the following one inequality.

$$(d/d_0)/(D_2/D_1)\leqq 0.75+0.025\gamma$$

The following expression (5) is derived therefrom.

$$(d/d_0)/(0.75+0.025\gamma)\leqq(D_2/D_1) \quad (5)$$

In order to solve the problem in facilities, such as strength, life or the like of the bearings, when the roll gorge diameter $D_g$ is set 4.5 times or more of the billet diameter "$d_0$", so as to provide an optimum roll shape without decreasing the inlet-side roll diameter excessively, the following inequality is obtained:

$$1.00-0.027\gamma<(d/d_0)/(D_2/D_1)$$

The following expression (6) is derived therefrom.

$$D_2/D_1\leqq(d/d_0)/(1.00-0.027\gamma) \quad (6)$$

The desirable roll shape condition is that satisfies the following expression (7) derived from the expression (6) and the above-mentioned expression (5).

$$(d/d_0)/(0.75+0.025\gamma)\leqq(D_2/D_1)\leqq(d/d_0)/(1.00-0.027\gamma) \quad (7)$$

Tables 1 and 2 show the cases in which the roll gorge diameter $D_g$=400 mm and $D_g$=500 mm respectively, and in the graphs of FIGS. 2 to 6, (a) shows the case with roll gorge diameter $D_g$=400 mm, and (b) shows the case with $D_g$=500 mm. Accordingly, the comparison between (a) and (b) leads to the discussion of the content of the second prior invention disclosed in Patent Document 2. An upper limit of the above inequality (expression (7)) can be easily obtained by performing the same calculation as in Tables 1 and 2 using $D_g$=315 mm.

$D_1$ and $D_2$ are respectively the inlet diameter and the outlet diameter of a cone-type main roll with the condition that the pipe material is bitten at an inlet surface of the main roll and separated from the roll at an outlet surface. More precisely, the diameter of the main roll in a position where the billet is bitten by the rolls is $D_1$, and the main roll diameter in a position where the hollow piece is separated from the rolls is $D_2$.

Finally, the barrel width of the roll will be described. The barrel width L is a total of $L_1$ and $L_2$ in FIG. 1. Addition of a margin to the barrel width beyond necessity leads to excessive enlargement of the whole structure of the mill. Accordingly, the inlet-side barrel width $L_1$ should be determined within a range which never impairs the stability of biting. The outlet-side barrel width $L_2$ should be determined in consideration of the reeling frequency of the finishing process. The barrel width ratio "$L_2/L_1$" is preferably set within the following range.

$$1.0\leqq L_2/L_1\leqq 2.0$$

EXAMPLE 1

A billet, having a diameter of 60 mm, made of 18% Cr-8% Ni austenitic stainless steel was used as a sample, and a high working ratio and a thin wall piercing with a pipe expansion ratio of 1.5 was carried out by use of a guide shoe. The heating temperature of the billet was 1250° C. Needless to say, the hot workability of the stainless steel is very poor compared with that of carbon steel.

1. Condition of Roll

Cross angle: γ=25°

Gorge diameter: $D_g$=400 mm

Feed angle: β=12°

Inlet diameter: $D_1$=240 mm

Outlet diameter: $D_2$=550 mm

Roll diameter expansion ratio: $D_2/D_1$=2.29

Inlet-side barrel width: $L_1$=300 mm

Outlet-side barrel width: $L_2$=460 mm

Barrel width: $L_1+L_2$=760 mm

Barrel width ratio: $L_2/L_1$=1.53

2. Piercing Condition

Plug diameter: $d_p$=80 mm

Billet diameter: $d_0$=60 mm

Hollow piece diameter: d=90 mm

Hollow piece wall thickness: t=2.7 mm

Pipe expansion ratio: $d/d_0$=1.50

Piercing rolling ratio: $d_0^2/4t(d-t)$=3.82

"Wall thickness/outer diameter" ratio: (t/d)×100=3.0%

Roll shape index: $(d/d_0)/(D_2/D_1)$=0.655

Radial logarithmic strain: $\psi_r=1n(2t/d_0)=1n0.09=-2.408$

Circumferential logarithmic strain:

$$\psi_\theta=1n\{2(d-t)/d_0\}=1n2.91=1.068$$

Reduction distribution ratio: $-\psi_r/\psi_\theta$=2.255

As described above, since the reduction distribution ratio of the circumferential direction to the radial direction, or the radial distribution ratio of the longitudinal direction to the circumferential direction was made properly, the piercing could be performed without causing flaring or peeling. Since the roll shape was also made properly, inner surface flaws or lamination was not observed even if a high working ratio and ultra-thin wall piercing of the difficult-to-work material were used.

EXAMPLE 2

High-alloy steel is poorer in hot workability than stainless steel, and frequently causes lamination at a piercing temperature which exceeds 1275° C. In this example, a billet, having diameter of 70 mm, made of 25% Cr-35% Ni-3Mo high-alloy steel was used as a sample, and the high working ratio and thin wall piercing, with a pipe expansion ratio of 2 was carried out at a temperature of 1200° C. by use of a disk roll.

1. Condition of Roll
Cross angle: $\gamma=300$
Feed angle: $\beta=12°$
Gorge diameter: $D_g=500$ mm
Inlet diameter: $D_1=300$ mm
Outlet diameter: $D_2=670$ mm
Roll diameter expansion ratio: $D_2/D_1=2.23$
Inlet-side barrel width: $L_1=300$ mm
Outlet-side barrel width: $L_2=460$ mm
Barrel width: $L_1+L_2=760$ mm
Barrel width ratio: $L_2/L_1=1.53$
2. Piercing Condition
Plug diameter: $d_p=130$ mm
Billet diameter: $d_0=70$ mm
Hollow piece diameter: d=140 mm
Hollow piece wall thickness: t=3.5 mm
Pipe expansion ratio: $d/d_0=2.00$
Piercing rolling ratio: $d_0^2/4t(d-t)=2.56$
"Wall thickness/outer diameter" ratio: $(t/d)\times100=2.5\%$
Roll shape index: $(d/d_0)/(D_2/D_1)=0.897$
Radial logarithmic strain: $\psi_r=1n(2t/d_0)=1n0.10=-2.303$
Circumferential logarithmic strain:

$$\psi_\theta=1n\{2(d-t)/d_0\}=1n3.90=1.361$$

Reduction distribution ratio: $-\psi_r/\psi_\theta=1.692$

As described above, since the reduction distribution to the circumferential direction and the radial direction was correctly accomplished, and also the roll shape was made appropriately, the piercing could be carried out without any problems, even in the high working ratio and the ultra-thin wall piercing of the difficult-to-work material.

INDUSTRIAL APPLICABILITY

In the piercing method of the present invention, the relationship between the pipe expansion ratio of the pipe material and the diameter expansion ratio of the cone-type main roll is correctly made. Accordingly, the rotary forging effects in the piercing process can be noticeably suppressed to definitely inhibit the inner surface flaws or lamination which is apt to occur in the high working ratio and thin wall piercing rolling of a difficult-to-work material, such as stainless steel or a high-alloy steel. According to the method of the present invention, pipe expansion piercing can be performed up to a pipe expansion ratio of 2.0.

As described above, the present inventor has proposed a high-cross-angle piercing method in order to diminish the rotary forging effects and suppress the redundant shear strain, and further achieved some other inventions. The higher cross angle is a necessary condition for diminishing the rotary forging effects and suppressing the redundant shearing deformation, but not a sufficient condition. The necessary and sufficient condition is optimization of the roll shape, and the higher cross angle is a necessary condition for the optimization of the roll shape.

Figure 1:
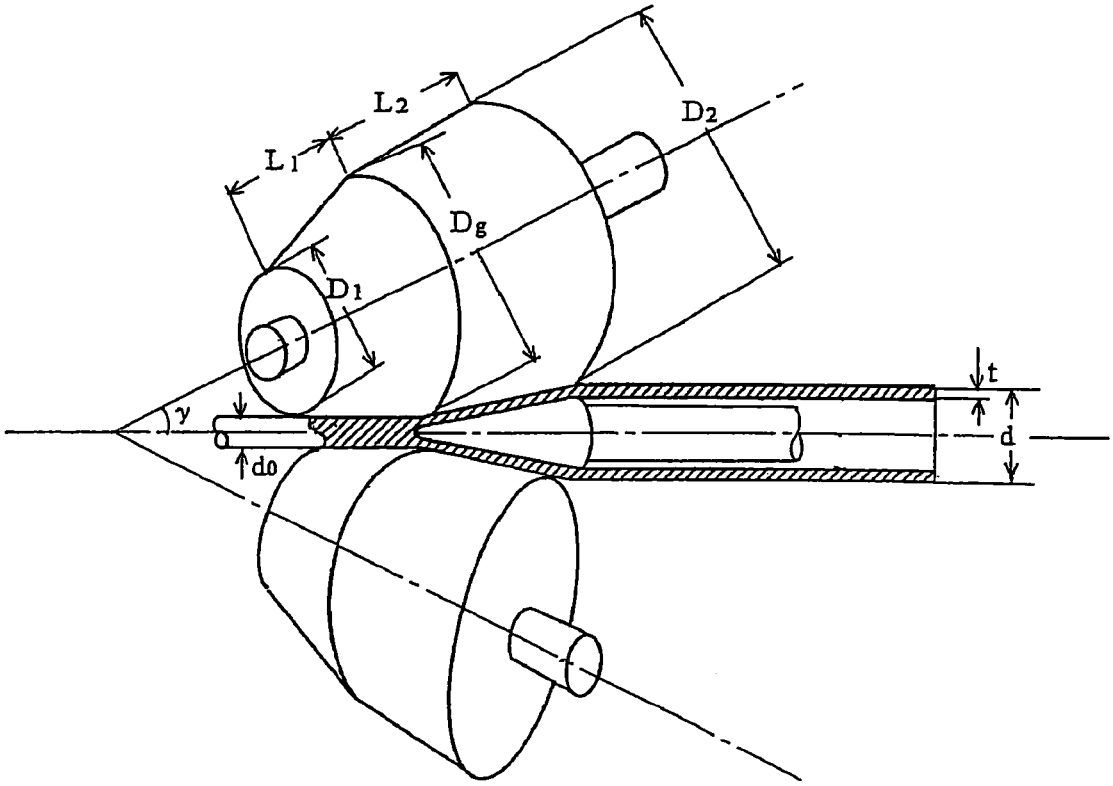
FIG. 1 is a view showing an embodiment of piercing rolling.
Figure 2:
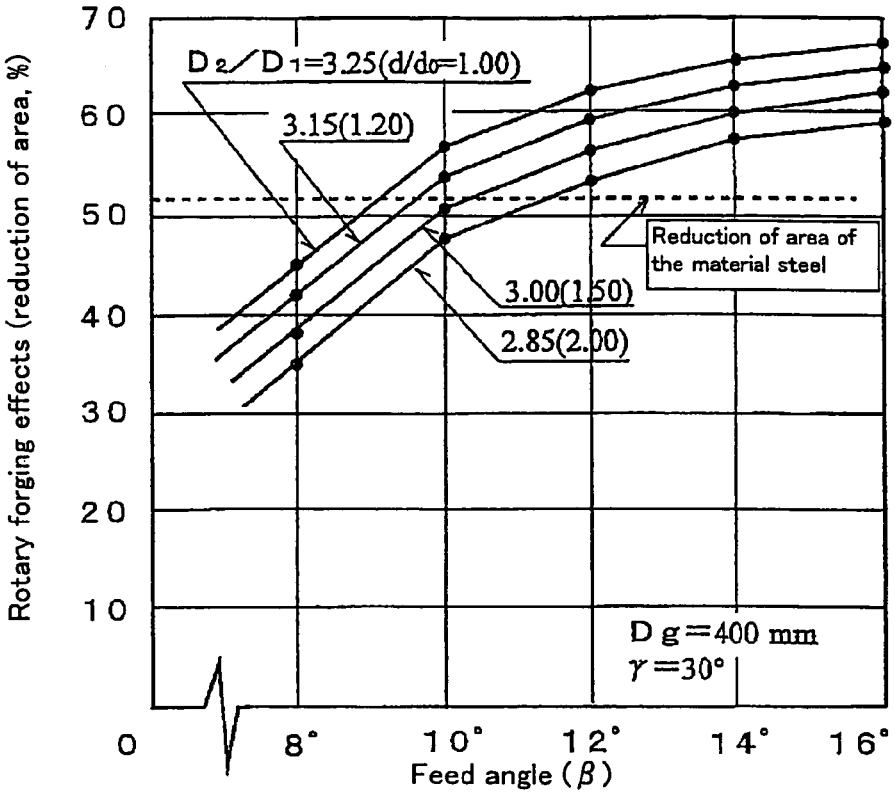
FIG. 2 is a view showing the influence of a diameter expansion ratio ($D_2/D_1$) and a pipe expansion ratio ($d/d_0$) on a rotary forging effects (reduction of area of a tensile test with a small test piece)
Figure 2:
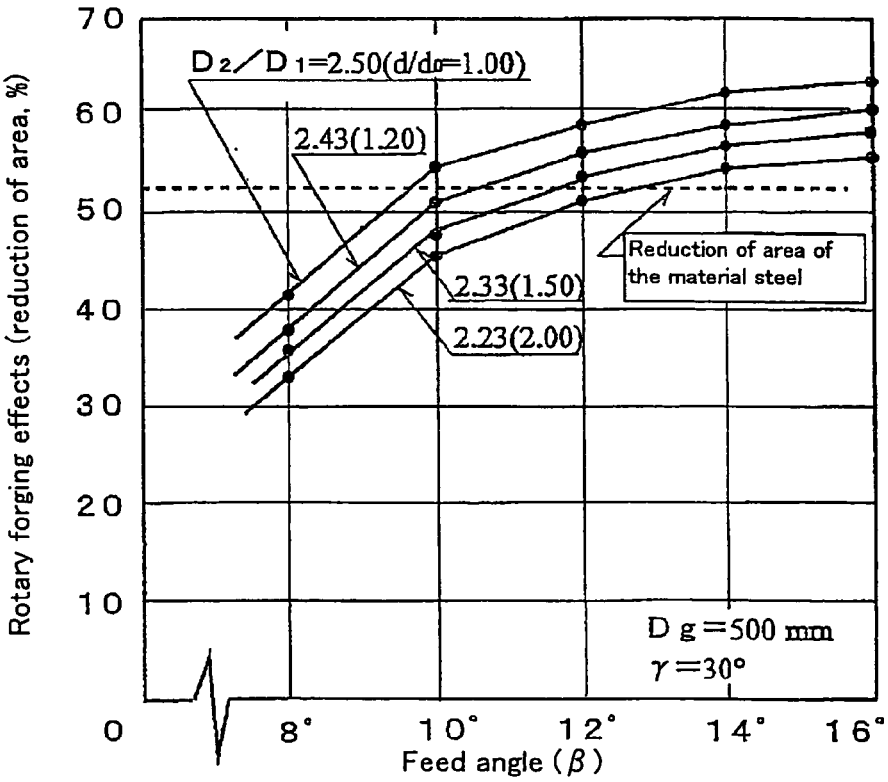
Figure 3:
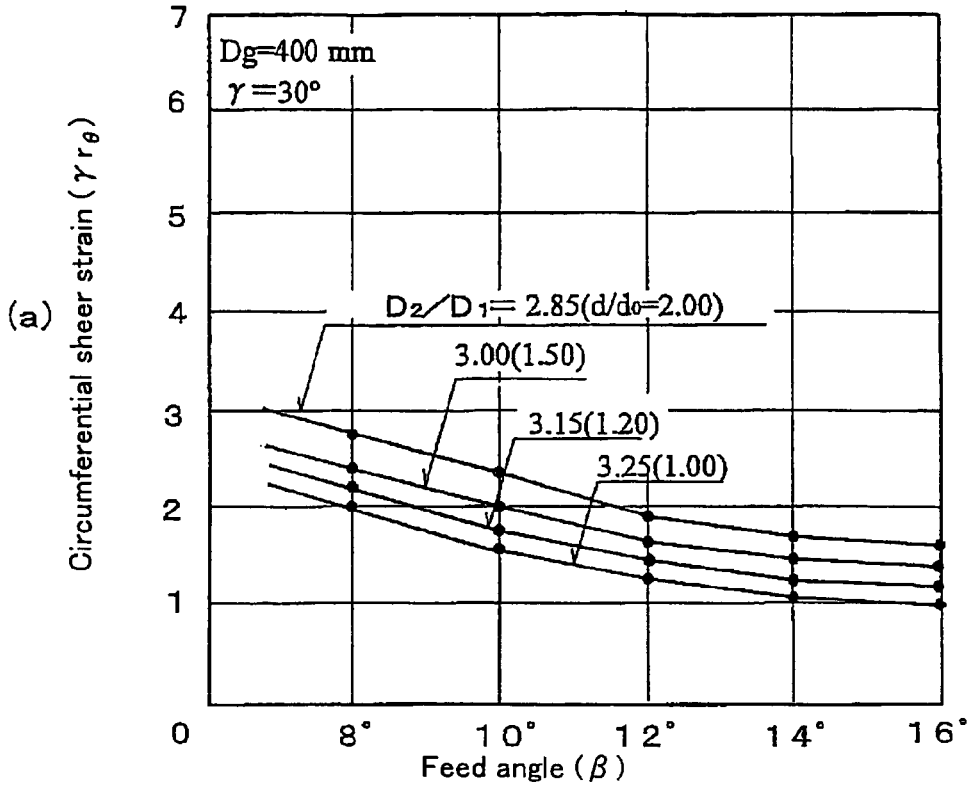
FIG. 3 is a view showing the influence of the diameter expansion ratio ($D_2/D_1$) and the pipe expansion ratio ($d/d_0$) on a redundant shear strain (circumferential shear strain)
Figure 3:
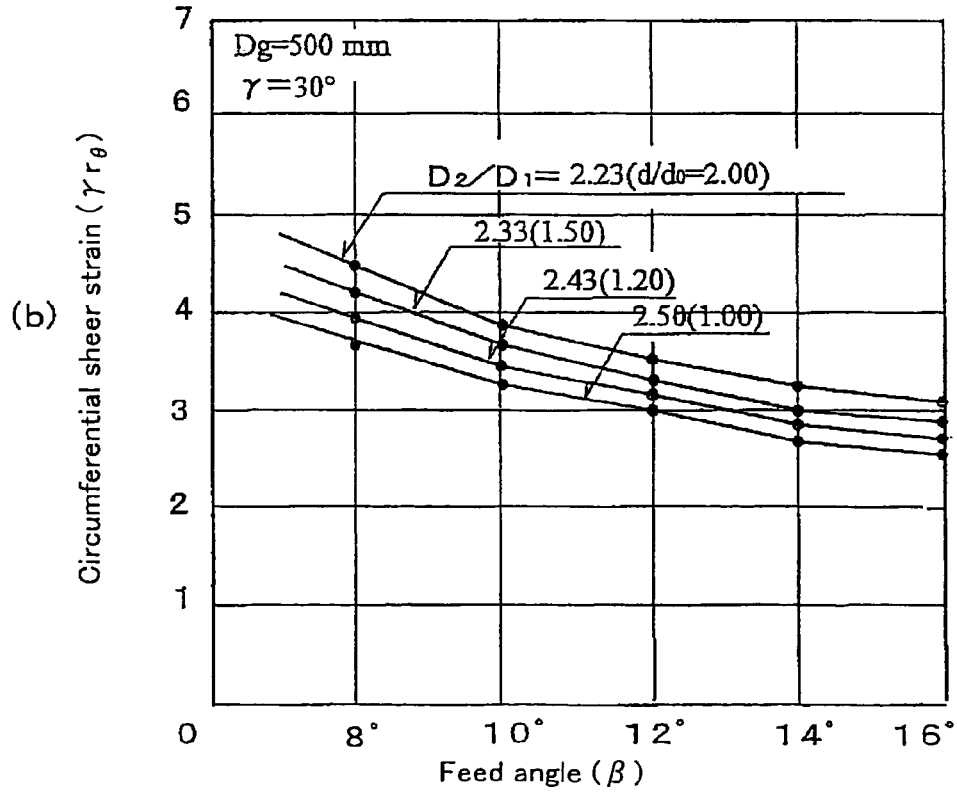
Figure 4:
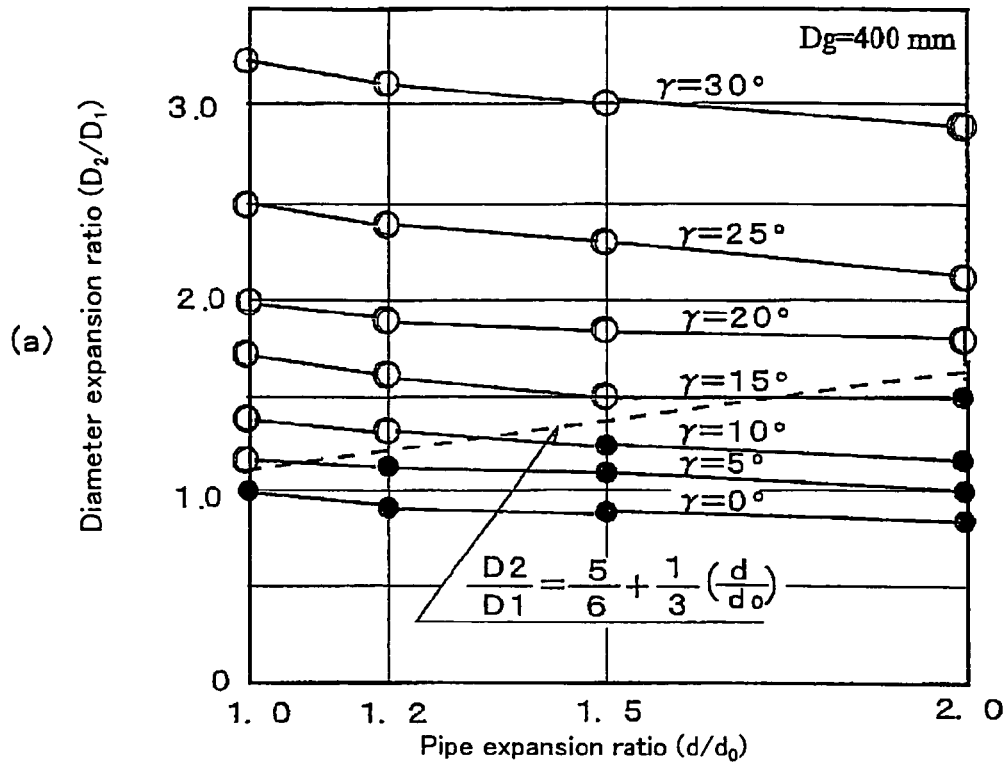
FIG. 4 is a graph showing the relationship between the diameter expansion ratio ($D_2/D_1$), the pipe expansion ratio ($d/d_0$) and a roll feed angle
Figure 4:
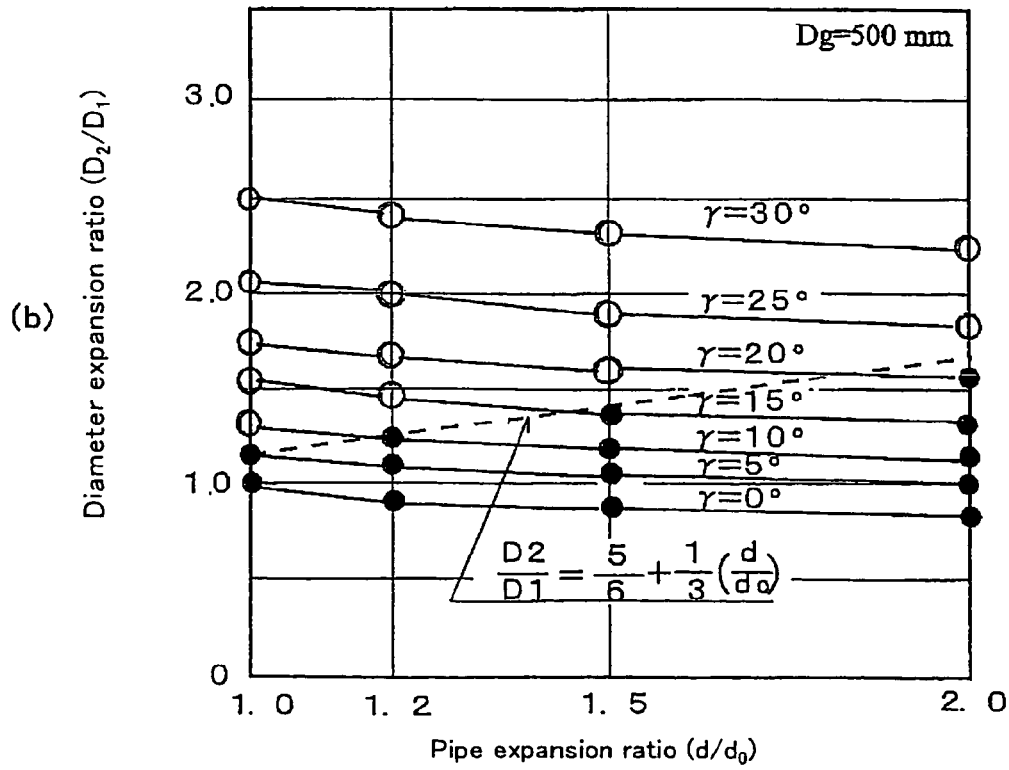
Figure 5:
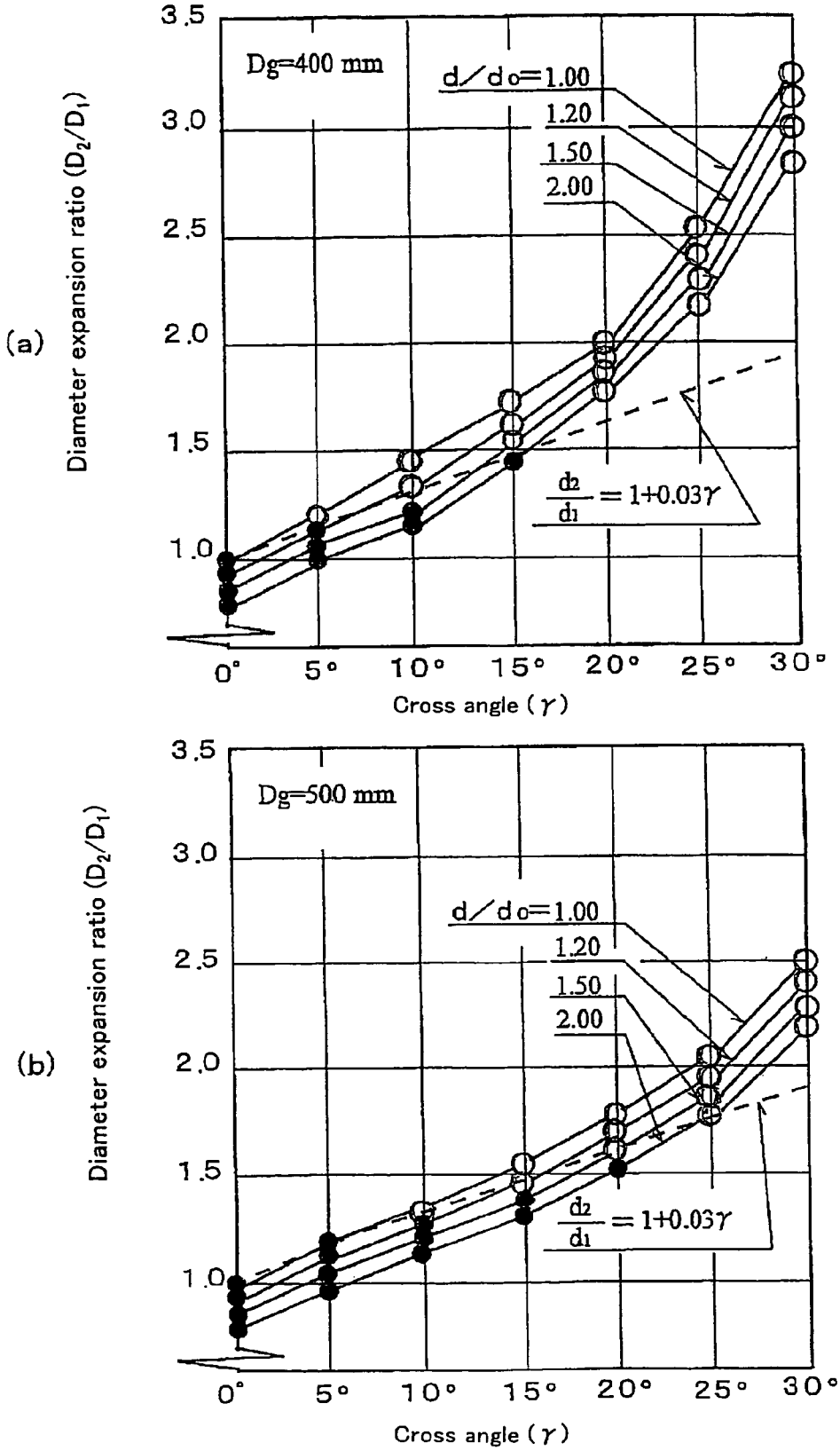
FIG. 5 is a graph showing the relationship between the diameter expansion ratio ($D_2/D_1$), the pipe expansion ratio ($d/d_0$) and a feed angle ($\gamma$)
Figure 6:
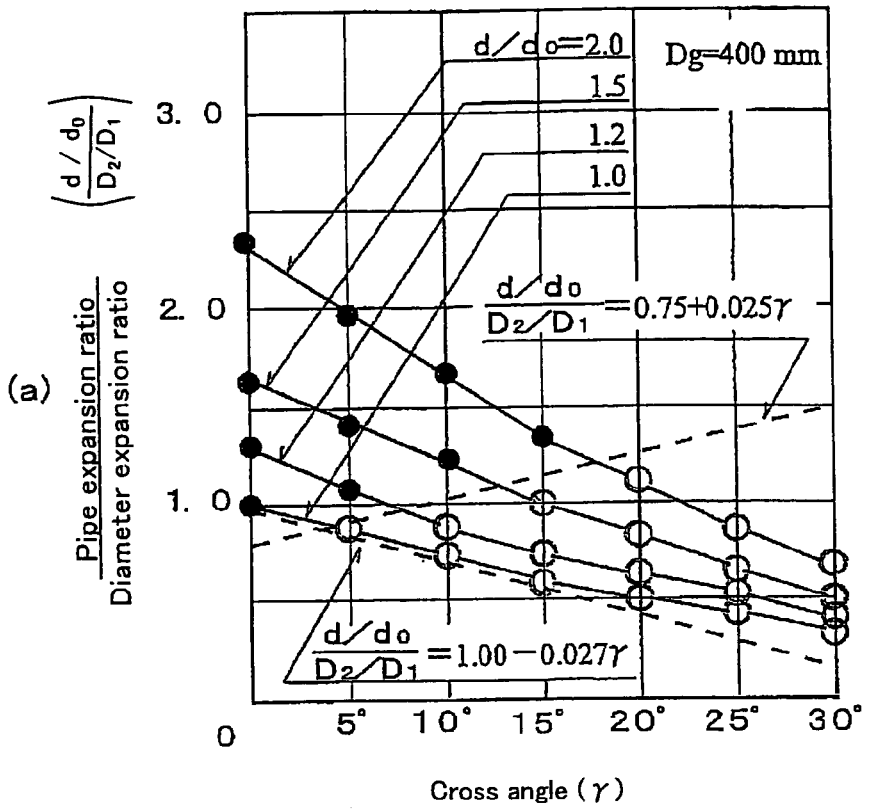
FIG. 6 is a graph showing the relationship between a roll shape index or $(d/d_0)/(D_2/D_1)$ and the roll cross angle ($\gamma$).
Figure 6:
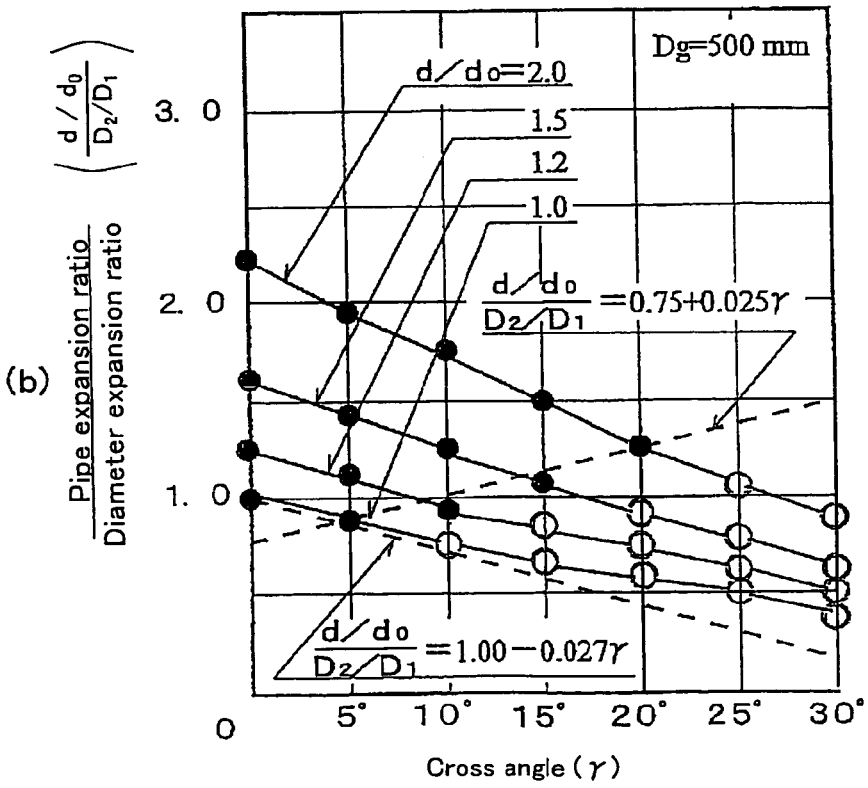

DESCRIPTION OF REFERENCE NUMERALS $\gamma$: Roll cross angle
$D_1$: Roll inlet diameter
$D_2$: Roll outlet diameter
$D_g$: Roll gorge diameter
$L_1$: Inlet-side barrel width of roll
$L_2$: Outlet-side barrel width of roll
$d_0$: Outer diameter of billet
d: Outer diameter of hollow piece
t: Wall thickness of hollow piece

The invention claimed is:

1. A piercing method for manufacturing a seamless pipe, comprising:

holding a feed angle $\beta$ and a cross angle $\gamma$ of both-ends-supported cone-type main rolls provided to be opposite laterally or vertically across a pass line in a range satisfying the following expressions (1) to (3);

setting the relationship between the outer diameter "$d_0$" of a solid billet and the outer diameter "d" and thickness "t" of a hollow piece after piercing so as to satisfy the following expression (4); and setting the relationship between inlet diameter $D_1$ and outlet diameter $D_2$ of the main rolls with the above-mentioned "$d_0$", "d" and $\gamma$ so as to satisfy the following expression (5)

$$8°\leqq\beta\leqq20° \quad (1)$$

$$5°\leqq\gamma\leqq35° \quad (2)$$

$$15°\leqq\beta+\gamma\leqq50° \quad (3)$$

$$1.5\leqq-\psi_r/\psi_\theta\leqq4.5 \quad (4)$$

$$(d/d_0)/(0.75+0.025\gamma)\leqq D_2/D_1 \quad (5)$$

In the expression (4), $\psi_r 1n(2t/d_0)$ and $\psi_\theta=1n\{2(d-t)/d_0\}$.

2. The piercing method according to claim 1, wherein the relationship between the inlet diameter $D_1$ and the outlet diameter $D_2$ of the main rolls with the above-mentioned "$d_0$", "d" and $\gamma$ satisfies the following expression (6)

$$D_2/D_1\leqq(d/d_0)/(1.00-0.0027\gamma) \quad (6).$$

3. The piercing method according to claim 1, wherein piercing is executed with a piercing ratio of 4.0 or more, and a pipe expansion ratio of 1.15 or more or a "wall thickness/outer diameter" ratio of the hollow piece of 6.5 or less.

4. The piercing method according to claim 2, wherein piercing is executed with a piercing ratio of 4.0 or more, and a pipe expansion ratio of 1.15 or more or a "wall thickness/outer diameter" ratio of the hollow piece of 6.5 or less.

* * * * *